United States Patent [19]

Wunner

[11] 4,003,222

[45] Jan. 18, 1977

[54] WARP KNITTING MACHINE FOR PRODUCING LOOPED CLOTH

[76] Inventor: Roland Wunner, Hauptstrasse 30, Bernstein, Wald, Germany

[22] Filed: July 21, 1975

[21] Appl. No.: 597,901

[30] Foreign Application Priority Data

July 23, 1974 Germany ..... 2435312

[52] U.S. Cl. ..... 66/84 R

[51] Int. Cl.[2] ..... D04B 23/06; D04B 23/08; D04B 23/10; D04B 23/12

[58] Field of Search ..... 66/83, 84, 86 R

[56] References Cited

UNITED STATES PATENTS

| | | | |
|---|---|---|---|
| 1,924,649 | 8/1933 | Morton | 66/84 A |
| 2,759,344 | 8/1956 | Clark et al. | 66/84 |
| 3,530,687 | 9/1970 | Hamano | 66/84 |
| 3,552,151 | 1/1971 | Schuler | 66/86 |

*Primary Examiner*—Ronald Feldbaum
*Attorney, Agent, or Firm*—Kenneth S. Goldfarb

[57] ABSTRACT

A warp knitting machine is adapted for the production of looped fabric by providing filler sinkers to supply filler threads extending over the entire width of the machine in parallel relationship. The filler threads arrive consecutively at the needle zone, and basic fabric and loops are produced simultaneously using warp threads and pile yarn, respectively. The filler sinkers perform a substantially rectangular movement ensuring a fail-safe operation with high operating speeds.

3 Claims, 10 Drawing Figures

WARP KNITTING MACHINE FOR PRODUCING LOOPED CLOTH

The present invention relates to the production of looped or ripple-cloth, terry pile fabrics and the like. Such fabrics are usually manufactured on looms or crochet gallon machines either with ready-made basic fabric, or with weft threads of sinuous or similar form having straight portions extending over only a small part of the entire width of the fabric. These methods of production are relatively expensive, and the production speed is low. In crochet gallon machines, the crochet needles are mounted horizontally, so the weft threads have to be supplied from above. Besides, a fabric so produced lacks sufficient dimensional stability.

It is an object of the present invention to overcome these difficulties and disadvantages of the prior art of manufacturing looped fabrics. The invention is based on the discovery that a high-speed warp knitting machine, particularly a Raschel machine, would be very suitable for the present purpose if the problem of feeding the weft or filler thread for this particular kind of fabric could be satisfactorily solved. As distinguished from ordinary operation of a warp knitting machine, pole threads must be worked into the fabric to form loops or pile. With increased speeds, this causes a tendency for faults and interruptions which renders the usual warp knitting machine inexpedient for production of looped fabric. However it has now been found that these difficulties can be overcome if synchronous supply of the filler threads over the entire width of the machine in parallel relationship is accomplished.

To bring the inherent advantages of the discovery into effect, the gist of the invention is to adapt a warp knitting machine for the purpose of manufacturing looped cloth by equipping it, in combination, with substantially fixed pole sinkers and with filler sinkers performing a substantially rectangular movement to ensure proper feeding of filler threads in parallel relationship over the entire width of the machine, thereby avoiding faulty connections of the pole loops with the basic fabric which is simultaneously produced. This allows for high operating speeds, and as the filler threads extend from one selvedge to the other, the fabric has very good dimension stability. The invention thus renders an important progress in the art of manufacturing looped cloth.

There are various ways of designing the filler sinkers and imparting the substantially rectangular movement. A suitable construction is, for example, to be found in U.S. Pat. No. 3,864,943 issued on Feb. 11, 1975 to the present inventor and assigned to the same assignee. This patent discloses a warp knitting machine which, among other features incompatible with the present invention, comprises a plurality of filler sinkers performing a substantially rectangular movement serving to separate one filler thread at a time out of a plurality of filler threads arriving horizontally and consecutively at the level of the upper edge of trick plates with knockover edges. The filler sinkers disclosed in said patent are intended to cooperate in timed relationship with a plurality of sinker plates performing a circular movement, which results in an entirely different method of manufacturing knitted fabric. However, it is possible to adapt the filler sinkers per se for the purpose of the present invention. The invention offers the possibility to manufacture looped or ripple-cloth on a high-speed warp knitting machine comprising, in combination, a row of vertical needles, a first row of thread guides for supplying warp thread to said needles a second row of thread guides for supplying pile yarn to said needles, a plurality of trick plates with knock-over edges, and means for feeding filler thread to said needles for producing basic fabric. Means are further provided for feeding a plurality of parallel filler threads extending over the entire width of the fabric and arriving horizontally at the level of the upper edge of said trick plates. A plurality of pole sinkers is disposed above and extending over and around the knock-over edges of said trick plates. The pole sinkers are adapted to form loops of the pile yarn to be interconnected with the basic fabric. A plurality of filler sinkers extends into the space between said trick plates and said needles and is movably mounted below said pole sinkers. Means are provided to impart to said filler sinkers a substantially rectangular movement consisting of consecutive horizontal and vertical sections in time relationship with the needle action. The filler sinkers are adapted to separate one filler thread at a time and transport it to the front side of said needles along the lower edges of said pole sinkers.

In operation, the pile yarn is formed into loops around the pole sinkers and connected with the basic fabric which is simultaneously produced. It is of special advantage to design and arrange the filler sinkers in such a way that their rectangular movement will, for a short time interval during the cycle, bring their tips into the zone between the pole sinkers which eliminates another possible cause for faults.

At least two rows of thread guides are provided mounted on guide bars in the usual manner. The first row serves to produce the basic fabric, the second to lay the pile yarn around the pole sinkers forming loops which are either tightly bound into or more loosely tied to the basic fabric.

Further objects and features of the invention will become apparent from the following description of a preferred embodiment with reference to the accompanying drawing in which.

Figure 1:
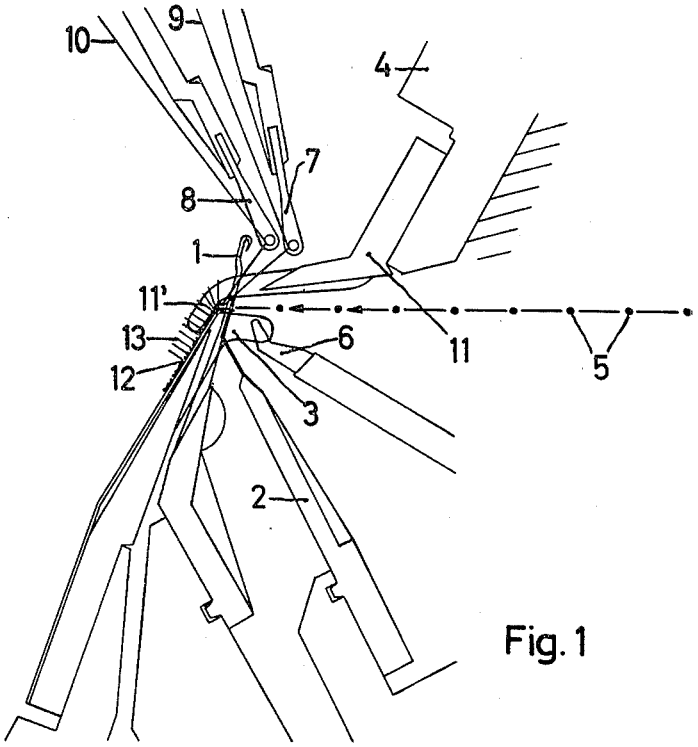
FIG. 1 is a lateral view of details of a machine according to the invention.

Referring to FIG. 1, there is shown a bearded needle 1 to be closed by a slide 2, Latch needles may be provided instead of bearded needles. The needles are disposed between trick plates 3 with knock-over edges. An automatic filler laying device of known type (not shown) at the back side of the needles supplies filler threads 5 in parallel relationship consecutively at the level of the upper edge of the trick plates 3. Filler sinkers 6 serve to transport the filler threads, one at a time, to the front side of the needles 1. The filler sinkers 6 perform a substantially rectangular movement consisting of vertical portions between the filler threads 5 and horizontal portions between the trick plates 3 thus feeding one filler thread after the other to the front side of the needles. The lateral distance of the individual filler sinkers may be four times the needle distance.

Above the trick plates 3, there are provided two rows of thread guides 7 and 8 mounted on respective guide bars. Guides 7 produce the basic fabric out of warp threads 9 and filler threads 5. Guides 8 lay pile yarn 10 around the pole sinkers 11 mounted on a pole bar 4. With fully set pole sinkers, the guides 7 produce fringe for the basic fabric. Guides 8 lay the pile yarn around the pole sinkers 11 giving a tight connection of the loops 13 with the basic fabric. The pole sinkers 11 are so designed that their distal ends 11' are extending around the front edge of the trick plates 3.

A modified method of operation is to have the guides 8 produce the basic fabric with warp threads 10, and the guides 7 lay the pile yarn 9 around the pole sinkers 11. The pile yarn may be tightly bound into the basic fabric; or else by using a fall plate or by setting the guides 7 to a lower level the pile yarn may be more loosely tied to the fabric. Both methods of operation are feasible.

A further variation is to set the pole sinkers according to a desired pattern, e.g. 1 full, 1 empty, or in other combinations.

Figure 2:
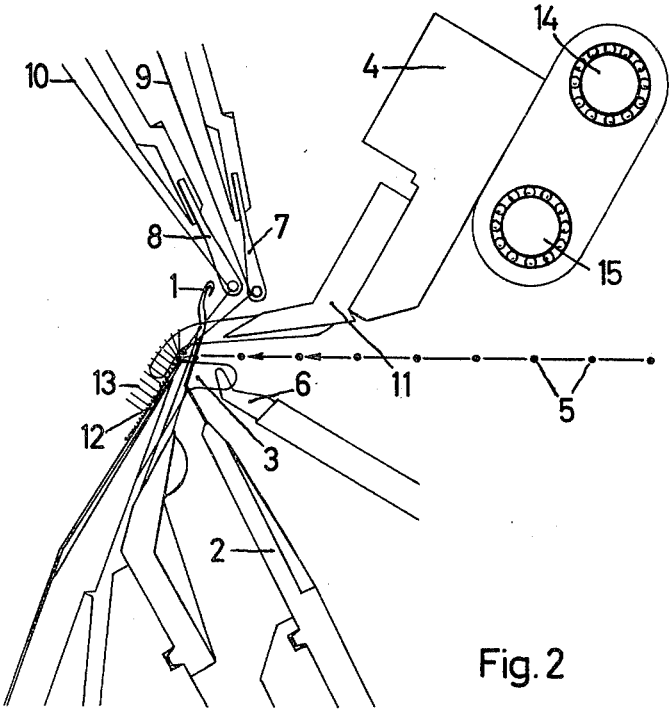
FIG. 2 shows a modification of the pole sinker arrangement.

In FIG. 2, there is shown a modification of the embodiment of FIG. 1 with the difference that the pole bar 4 is slidably mounted on ball bearing 14, 15 and can be shifted in a direction parallel to the filler threads. This movement may be controlled by pattern chains, cam drives or pattern drums and offers the additional advantage that, with fully set pole sinkers, by reciprocating the pole bar by a needle distance a basic fabric in tricot binding can be produced which contains filler threads extending over the entire width. Such a tricot weave has an exceptional high degree of dimensional stability.

Figure 3:
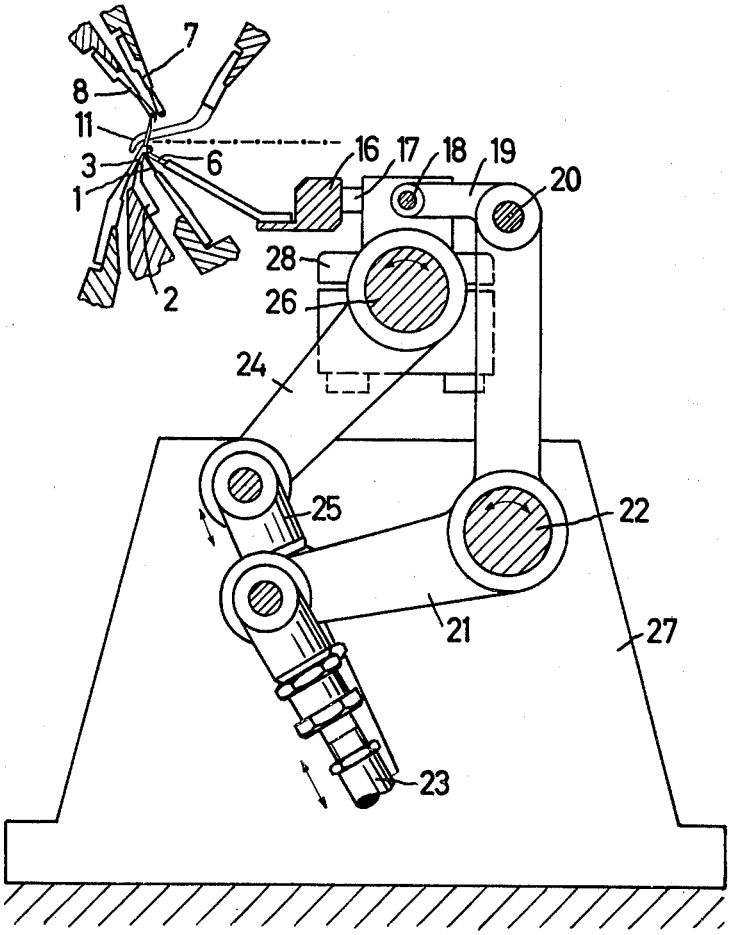
FIG. 3 is a sectional view of the driving mechanism of the filler sinkers.

Referring now to FIG. 3, parts corresponding to those shown in FIGS. 1, 2 have the same reference numeral. The filler sinkers 6 are shown mounted on a bar 16 to which are screwed brackets 17 holding a bolt 18. A member 19 is rotatably linked to bolts 18 and 20, the latter being held by brackets secured to a lever 21, which is pivoted at 22 and performs a swinging motion actuated by a rod 23 controlled by the machine drive. This causes a horizontal reciprocating movement of the bar 16 bearing the filler sinkers 6.

A second lever 24, actuated by a second rod 25, is keyed to a shaft 26 rotatably mounted in the machine frame as indicated by numeral 27. Keyed to the shaft 26 is a holder 28 for a ball guide which allows for a horizontal movement of the bar 16, according to the movement of the rod 23. Actuation of the rod 25 controlled by the machine drive causes a substantially vertical movement of the tips of the filler sinkers 6. The combined movement of the filler sinkers 6 is, therefore, approximately rectangular if the reciprocating movements of the rods 23, 25 are controlled accordingly by suitable means (not shown), e.g. cam wheels, coupled to the machine drive.

Figure 4:
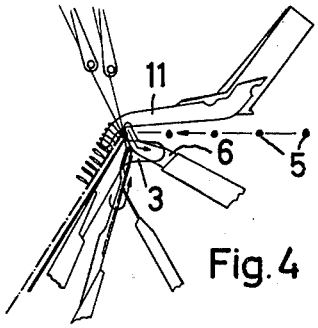
FIGS. 4 – 10 show consecutive positions of the various implements of the machine during an operating cycle.
Figure 5:
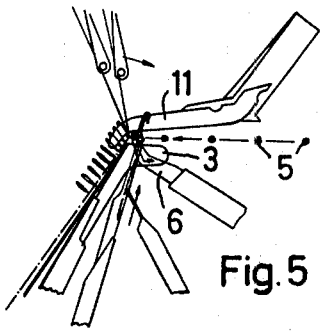
Figure 6:
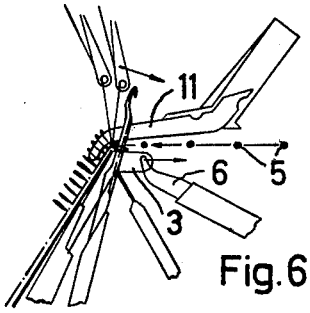
Figure 7:
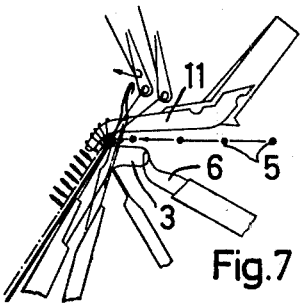
Figure 8:
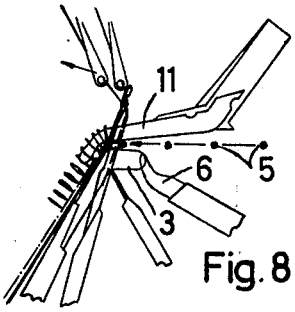
Figure 9:
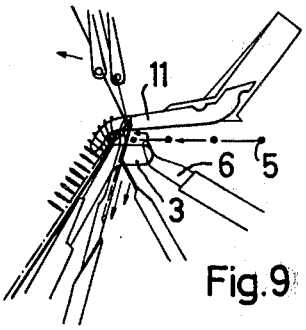
Figure 10:
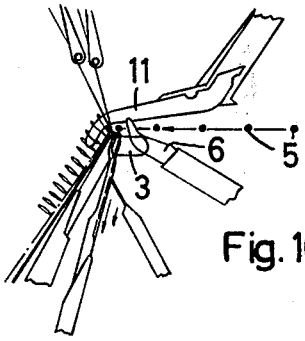

FIGS. 4 – 10 show consecutive phases of an operating cycle of the machine. It can easily be seen that the filler sinkers 6, from the position shown in FIG. 4 move down, to the right, then up again to separate a filler thread, and then back to the left to supply the filler thread to the front side of the needles. The needles and thread guides perform movements in timed relationship. As shown in FIGS. 4 and 10, for a short interval of the cycle the tips of the filler sinkers enter the space between the pole sinkers 11. This operation is possible also with lateral shifting of the pole bar as described in connection with FIG. 2 since the shifting movement of the pole bar takes place in time intervals when the tips of the filler sinkers are retracted from the pole sinker zone so that no mutual interference will occur.

While specific embodiments of the invention have been shown and described in detail, if will be apparent to persons skilled in the art that numerous changes and modifications are reasible without departing from the spirit and scope of the invention which opens a new method of producing looped fabric on high speed warp knitting machines.

I claim:

1. A warp knitting machine for producing looped or ripple-cloth comprising, in combination, a row of vertical needles, a first row of thread guides for supplying warp thread to said needles, a second row of thread guides for supplying pile yarn to said needles, a plurality of trick plates with knock-over edges, means for feeding filler thread to said needles for producing basic fabric, a plurality of parallel filler threads extending over the entire width of the fabric to be produced and being prepared to arrive horizontally at the level of upper edge of said trick plates, a plurality of pole sinkers disposed above and extending over and around the knock-over edges of said trick plates and secured to a bar slidably mounted on bearings, means for controlled reciprocating shifting of said bar in a direction parallel to the filler threads, said pole sinkers being adapted to form loops of the pile yarn to be interconnected with the basic fabric being produced simultaneously therewith, a plurality of filler sinkers extending into the space between said trick plates and said needles and movably mounted below said pole sinkers, and means for imparting to said filler sinkers a substantially rectangular movement consisting of horizontal and vertical sections in timed relationship with the needle action, said filler sinkers being adapted to separate one filler thread at a time and transport it to the front side of said needles along the lower edges of said pole sinkers.

2. A warp knitting machine as claimed in claim 1, said shifting of said pole sinker bar extending over one needle distance.

3. A warp knitting machine as claimed in claim 1, said filler sinkers being dimensioned and arranged in such a way that for a short time interval during said rectangular movement and while transporting said filler thread, the tips of said filler sinkers enter the zone between adjacent two of said pole sinkers.

* * * * *